United States Patent [19]

Olander et al.

[11] Patent Number: 4,604,953

[45] Date of Patent: Aug. 12, 1986

[54] VOID-SENSING FUZE

[75] Inventors: Donald E. Olander, Westminster; Harold J. Woods, Lomita, both of Calif.

[73] Assignee: Hi-Shear Corporation, Torrance, Calif.

[21] Appl. No.: 604,066

[22] Filed: Apr. 26, 1984

[51] Int. Cl.[4] ..... F42C 1/08; F42C 15/04; F42C 15/22

[52] U.S. Cl. ..... 102/272; 102/241; 102/245; 102/273

[58] Field of Search ..... 102/272, 273, 274, 275, 102/271, 245, 246, 237, 239, 266, 268

[56] References Cited

U.S. PATENT DOCUMENTS

| | | | |
|---|---|---|---|
| 2,487,789 | 11/1949 | Carr et al. | 102/272 X |
| 2,495,432 | 1/1950 | Thompson | 102/245 |
| 2,962,968 | 12/1960 | Neuwirth et al. | 102/245 |
| 3,636,880 | 1/1972 | Aske | 102/266 X |
| 3,913,486 | 10/1975 | Kosonocky et al. | 102/241 |
| 3,995,557 | 12/1976 | Engel et al. | 102/273 X |
| 4,458,594 | 7/1984 | Weber et al. | 102/245 X |

*Primary Examiner*—David H. Brown
*Attorney, Agent, or Firm*—Donald D. Mon

[57] ABSTRACT

A void-sensing fuze whose initiation is deferred until after impact forces have terminated. A safety device safeties the fuze until after the ordnance has fired. Thereafter, upon impact the fuze is committed to fire, but fires only after impact forces have terminated.

14 Claims, 8 Drawing Figures

VOID-SENSING FUZE

FIELD OF THE INVENTION

This invention relates to a fuze for ordnance which is committed to fire during penetration of a target and is fired after impact such as but not limited to, after the passage through a wall or other body being penetrated by the ordnance carrying this fuze, or after grazing off of a target.

BACKGROUND OF THE INVENTION

There exists a requirement for a fuze to detonate ordnance after the ordnance has passed through an object to be penetrated, or after it has grazed off of a target. An example is the firing of the ordnance after it has passed through the protective shell of a troop carrier.

Ordnance which explodes outside of protective armament does have utility, of course, but maximum damage is done to the occupants if the ordnance passes through the armament and explodes inside, or which after grazing or bouncing off of a target, explodes nearby, rather than surviving as a dud.

It is an object of this invention to provide a fuze for these purposes, which is mechanically simple and does not require burning fuze trains or electronic means for its actuation.

BRIEF DESCRIPTION OF THE INVENTION

A void-sensing fuze according to this invention is adapted to fire after termination of mechanical impact forces. It includes a fuze case that has an internal cavity, the internal cavity having an axis of forward motion. A rotor case in this cavity is adapted for motion relative to the fuze case along the axis, the rotor case having safety means. In the preferred embodiment, the safety means includes a ball rotor that is seated in a ball seat in the rotor case and has a detonator passage for holding a detonator means. The detonator passage has an axis passing through the center of the ball rotor and contains a detonator, the ball having freedom to rotate from a first position where the said two axes cross, to a second position where they are coincident. This is a well-known exemplary safety means for ordnance.

Limit stop means on the cases coact to limit the movement of the rotor case relative to the fuze case in the direction opposite from the direction of forward flight. A commit latch is placed between the cases and is adapted to permit the rotor case to move relative to the fuze case in the direction of forward flight, from a first position defined by the limit stop means, to a second position spaced therefrom, and to latch the cases together in said second position when it is attained. A firing pin in the cavity is movable along the axis. It includes a shaft, a first end, and retention means at its second end. A firing pin spring is interposed between the firing pin, and the rotor case is adapted to be deflected so as upon release to drive the firing pin toward the detonator. Sear means is pivotally mounted to the fuze case in the cavity, and in its preferred embodiment it includes a retention surface that is engageable with a retention means on the firing pin tending when engaged to hold the pin away from the detonator. The sear normally is held by the rotor case in its first position so as to hold the sear engaged to the firing pin. It is releasable therefrom when the rotor case moves to its second position whereby it releases the firing pin.

According to presently preferred but optional features of the invention, the sears are biased apart by a sear spring, a detonator is placed in the detonator passage, and a portion of a detonator train associated with a charge to be fired is engageable with the detonator when the fuze from the rotor case is in its second position.

The above and other features of this invention will be fully understood from the following detailed description and the accompanying drawings, in which:

DETAILED DESCRIPTION OF THE INVENTION

Figure 1:
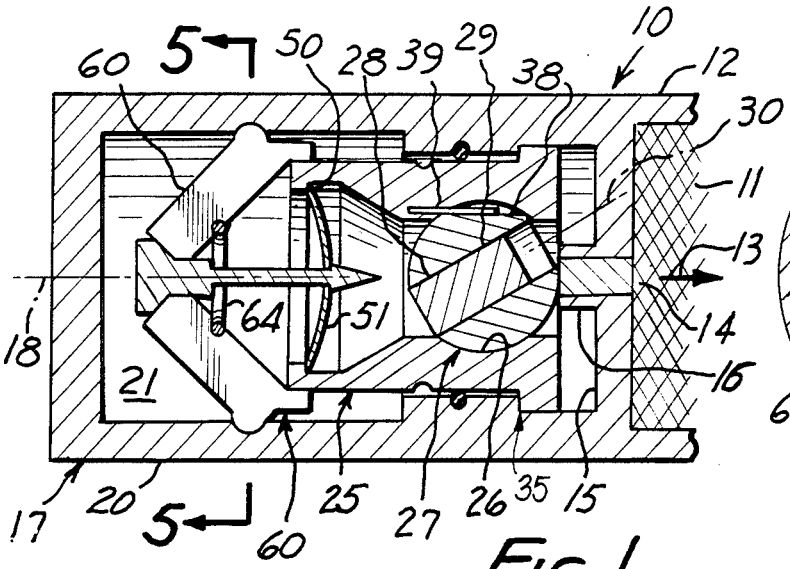
FIGS. 1–4 are sequential axial views partly in schematic notation showing the presently preferred embodiment of the invention sequentially in its safe, armed, committed to fire, and fired conditions.
Figure 5:
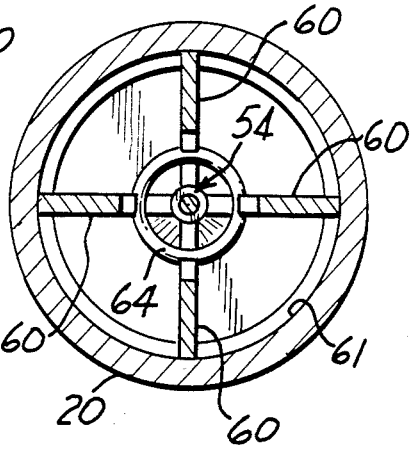
FIG. 5 is a cross-section taken at line 5—5 in FIG. 1.

The preferred embodiment of the invention is shown in FIG. 1 wherein a shell 10 or other ordnance device is fragmentarily shown. A charge 11 of explosive material is held in the forward section of its case 12. The direction of forward flight is shown by arrow 13. There is a passage 14 through a bulkhead 15 terminating in a boss 16 opening into the fuze section 17 of the ordnance. The shell may be shaped in any desired configuration and is intended to spin around its axis of forward motion 18, which is the central axis on which the centroid is located. The fuze section includes a fuze case 20 which is preferably cylindrical and which has a cavity 21 that is centered on said axis 18. A rotor case 25 (sometimes called a "fuze case") is disposed in the cavity adapted for motion relative to the fuze case along axis 18. The rotor case has a ball seat 26 on the said axis. The ball seat receives a ball rotor 27 which has within it a detonator passage 28 that passes through the center of the ball rotor and contains a detonator 29 which extends to the left hand end of the passage in FIG. 1 but is recessed from the right hand therein for a reason which will become evident. The ball has freedom to rotate from the first position shown in FIG. 1 where the detonator passage axis 30 crosses axis 18 to a second position shown in FIG. 2 where these axes are coincident.

Figure 2:
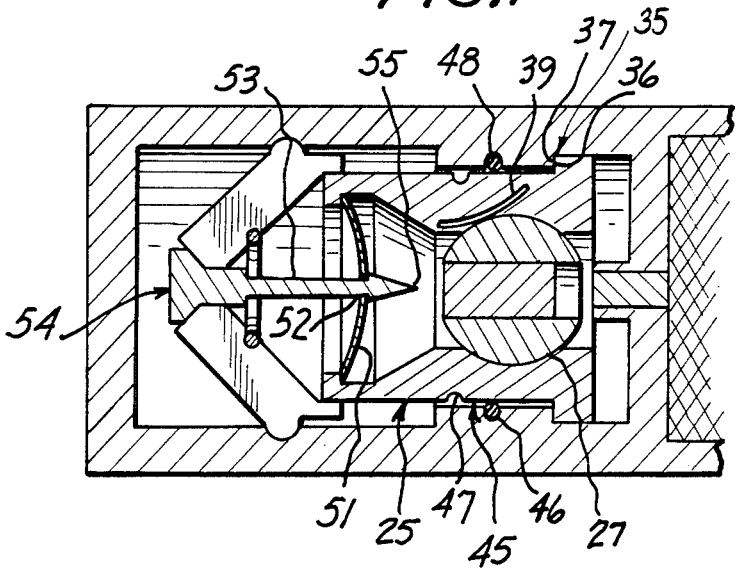

Limit stop means 35 comprises a shoulder 36 on the fuze case and a shoulder 37 on the rotor case adapted to abut one another in the first position of the rotor case relative to the fuze case which is the most rearward position relative to the axis of forward motion (FIGS. 1 and 2).

A flat 38 is formed on the ball rotor which is engaged by a spin latch 39. The spin latch is a flexible finger or plate which is deflectable as will be seen, but in its normal position tends to bear against the flat and hold the ball rotor in its first position as illustrated in FIG. 1.

The ball rotor provides an offset in the fuze train, i.e., a break in its continuity, and thereby constitutes "safety means". This is a conventional safety device which is widely used in artillery ammunition. It is merely a single example of a wide range of safety devices, many of which could be substituted for it. However, this design is greatly favored in this field. It will also be observed that the detonator is offset from the firing pin.

A commit latch 45 comprises a groove 46 in the wall of the fuze case, a groove 47 in the wall of the rotor case, and a split snap ring 48 which rides in groove 47 and ultimately connects (bridges) them as will later be seen.

The rotor case also includes a spring shoulder 50 which is a circular shoulder in which there is placed a firing pin spring 51. The spring may be a blade if desired, or perhaps a generally domed structure whose general shape in section is that shown in FIG. 1. This is the shape to which it tends to want to return. A port 52 in it passes the shaft 53 of firing pin 54. The firing pin at its first end 55 has a sharp point, and a shoulder 56 which can bear against the spring. The firing pin further includes a retention means 57 comprising a cylindrical surface 58 and a frusto-conical tapered surface 59. The purpose of this retention means is to coact with sears 60 of which there may be four in number, uniformly spaced apart. They are conveniently seated in a peripheral groove 61 in the wall of the cavity in the fuze case. Each sear includes a lever 62 adapted to overhang the rotor case when the rotor case is in its first position. The sear further has retention surfaces 63 which bear against the firing pin and hold it in the position as shown relative to the fuze case. A sear spring 64 which may be a compressed split ring fits in a groove 65 in each of the sears so as to bias them apart. This tends of course to hold the lever 62 firmly engaged against the rotor case. The sear has a fulcrum 66 pivotally seated in groove 61.

Figure 8:
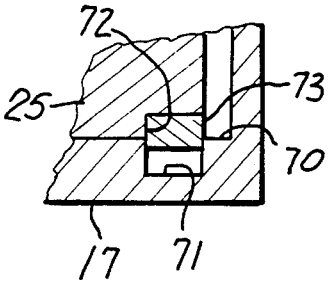
FIG. 8 is a fragmentary section of part of a variation of the invention.
Figure 7:
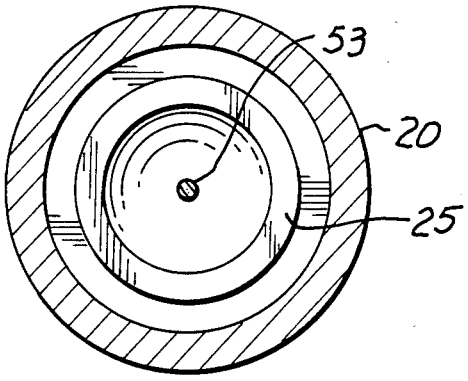

FIG. 8 shows an optional means for holding rotor case 25 retracted. The lower right hand portion of the view in FIG. 1 is shown, modified to include a circular step 70. This forms a groove 71 in the wall of the cavity. A peripheral step 72 is formed on the end of the rotor case. A snap ring 73 embraces the rotor case, and in its relaxed position as shown, bridges across cases 17 and 25, holding back the rotor case. Centrifugal force will expand the ring into groove 71 so as to free the rotor case for forward motion. Then boss 16 need not be provided nor does the detonator have to be recessed in the detonator passage.

A stool can be provided behind the firing pin to position it correctly relative to the sears.

The term "sear" as used herein is used broadly for a device which will hold the firing pin during impact and release it after impact. Thus, the illustration is simply exemplary of many types of "sears".

The operation of the device will now be described. In the safe condition before and during setback, the fuze arrangement is as shown in FIG. 1, with the rotor ball in its first position held there by the spin latch, with the firing pin held back by the sears as shown. The commit latch is not engaged. The rotor case will be held in its illustrated condition also by the rotor ball which bears against the boss to prevent its movement to the right in FIG. 1.

The device becomes armed as shown in FIG. 2 when the ordnance is fired. This fuze is utilized with armament which has a rapid spin around its axis of flight. The centrifugal forces have several effects. One is that the spin latch is disengaged, and the other is that the spin force will tend to align the ball in its second position with its axis coincident with the axis of forward flight. Under these circumstances, the passage through the rotor ball is aligned with the boss and it is freely movable forwardly when impact forces occur. It will be noted that there is no force present which will cause the rotor case to move forward relative to the fuze case during set-back. It will also be noted that the arming actuation has involved only the rotation of the ball rotor to its axially aligned position.

Figure 3:
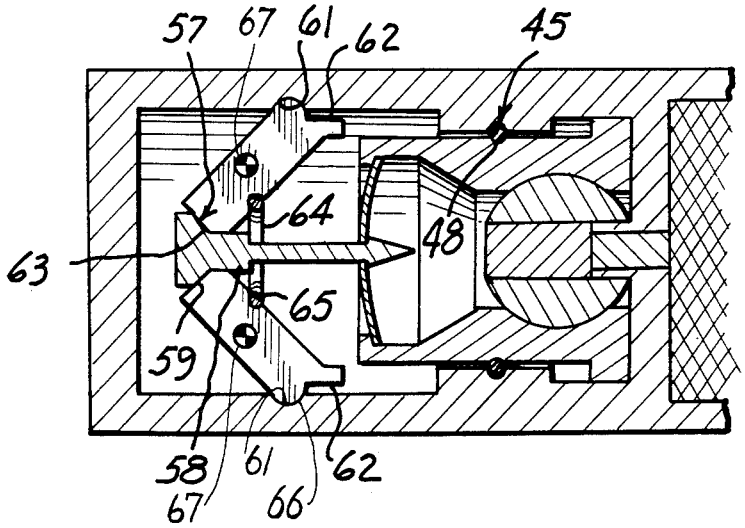
Figure 4:
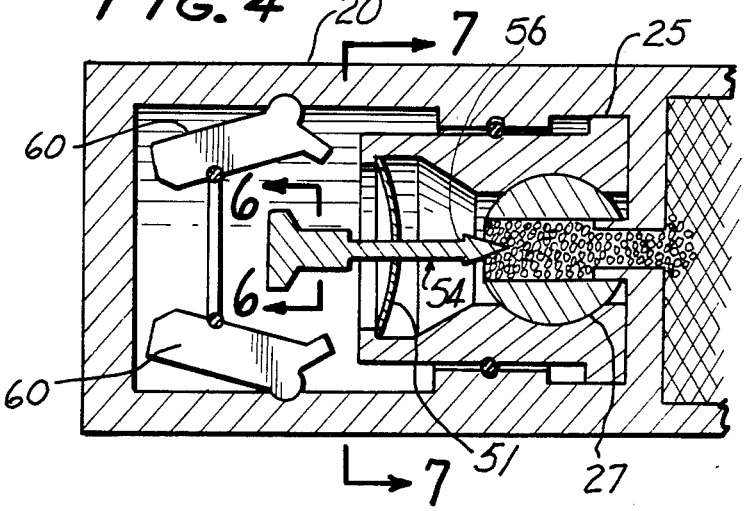
Figure 6:
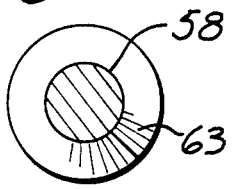
FIGS. 6 and 7 are cross-sections taken respectively at lines 6—6 and 7—7 in FIG. 4.

The next condition is shown in FIG. 3 which is what occurs at impact of the shell with its target. The condition is shown just after impact, and it will be noted that the rotor case has moved forward to its second position where it abuts the forward bulkhead and that commit latch becomes engaged by bridging between the two cases. It will also be noted that the boss has entered into the detonator passageway in the ball rotor. Because the sears hold the firing pin back, the spring engages on the shoulder 56 and pulls the spring back to a "cocked" position as illustrated. The impact forces acting on the sears prevents their disengagement. Their centers of gravity 67 are shown are spaced inwardly from their point of rotation in the groove so that the forward motion tends only to make the sears lock more tightly on the firing pin. This condition pertains until the impact forces are terminated. Of course one of the most common means of terminating the impact force especially when firing through metal vehicle is when the shell enters the inside of the vehicle and is no longer decelerated as part of the impact reaction. Another occurs when the shell grazes the vehicle or aircraft suffers an impact, and then flies away. The impact forces are then also terminated. This condition is shown in FIG. 4 and is referred to herein as void-sensing, or fired. It will be noted that the sears have been thrust apart by the sear spring so as to release the firing pin which is propelled by the spring toward the detonator which initiates it. The initiation is schematically shown in FIG. 4.

Thus it will be seen that this device is a simple mechanical assembly which may be armed by the spinning of the ordnance on its way to the target, is committed to fire as a consequence of impact, and fires after the impact forces terminate to the extent that the sears release the firing pin.

This invention is not to be limited by the embodiments shown on the drawings and described in the description which are given by way of example and not of limitation, but only in accordance with the scope of the appended claims.

We claim:

1. A fuze adapted to fire after termination of mechanical impact forces, said fuze having an axis of forward motion, and comprising:

a fuze case having an axial internal cavity;

a second case in said cavity adapted for motion relative to said fuze case along said axis, safety means carried by said second case preventing initiation until released;

detonator means carried by said second case;

limit stop means on said cases which cooperate to limit the movement of the second case relative to the fuze case in an axial direction opposite from said forward motion;

a commit latch between said cases adapted to permit said second case to move relative to the fuze case in the direction of forward motion, from a first position defined by the limit stop means to a second position spaced therefrom, and to latch said cases together in said second position when said second position is attained;

a firing pin axially movable along said cavity axis, said firing pin having a shaft, and a first end;

a firing pin spring interposed between said firing pin and said second case adapted to be deflected so as upon release to drive said firing pin toward said second case;

a sear carried by said fuze case in said cavity, said sear being engageable with said firing pin tending, when engaged to hold said firing pin away from said second case, and releaseable therefrom when said second case moves to its said second position whereby to release said firing pin;

whereby during forward flight, said safety means is disengaged;

whereby upon impact, said rotor case moves to its second position, said firing pin pulls said firing pin spring to a spring-loaded position, and said commit latch locks said rotor case in its second position, said sear continuing to engage said firing pin, and whereby upon cessation of impact forces said sear is disengaged from said firing pin, and said firing pin spring propels said firing pin toward said detonator to strike and initiate it.

2. A fuze according to claim 1 in which said safety means comprises means to offset said detonator from said axis.

3. A fuze according to claim 1 in which said commit latch comprises a peripheral ring surrounding said second case, and respective peripheral grooves in the inside wall of said cavity and the outside wall of said second case, said ring being so proportioned and arranged as to enter both of said grooves and to retain said second case in its second position, when said last-named second position is attained.

4. A fuze according to claim 1 in which a bulkhead is formed at the forward end of said cavity, and in which a boss with a passage therethrough projects into said cavity on said axis, aligned with the detonator when the fuze has spun around its axis.

5. A fuze according to claim 1 in which said second case is a rotor case having a ball seat on said axis, and in which said safety means comprises a ball rotor mounted in said ball seat and having a detonator passage for holding said detonator, said detonator passage having an axis passing through the center of the ball rotor, said ball rotor having freedom to rotate from a first position where said two axes cross, to a second position where they are coincident, spinning of said fuze creating centrifugal force which moves said ball rotor to said second position.

6. A fuze according to claim 5 in which a spin latch holds said ball rotor in said first position until unlocked by said centrifugal force.

7. A fuze according to claim 5 in which said sear spring is an expansive ring.

8. A fuze according to claim 1 in which releasable means restrains said second case in its first position, said releasable means being released by centrifugal force developed by spinning of said fuze.

9. A fuze according to claim 8 in which said releasable means is a snap ring bridging between said cases.

10. A fuze according to claim 1 in which said sear includes a fulcrum member, a lever, and retention means, in which said fuze case has a recess in its cavity wall to receive said fulcrum member, and in which the center of gravity of said sear is radially inwardly of said fulcrum, whereby decelerative impact forces cause said sear more tightly to press its retention means against said firing pin.

11. A fuze according to claim 10 in which there is a plurality of said sears, and in which a sear spring biases said sears to release said firing pin upon cessation of impact force, said deceleration effects overcoming said bias while impact forces persist.

12. A fuze according to claim 11 in which said sear spring is an expansive ring.

13. A fuze according to claim 10 in which retention means on said firing pin includes a portion generally parallel to said axis, and a portion inclined to it, and in which said retention means on the sear is generally complementary thereto.

14. A fuze according to claim 13 in which said portions are generally cylindrical and frusto conical, respectively.

* * * * *